US010689723B2

(12) United States Patent
Koyanagi et al.

(10) Patent No.: US 10,689,723 B2
(45) Date of Patent: Jun. 23, 2020

(54) FERRITIC STAINLESS STEEL AND HEAT-RESISTANT MEMBER

(71) Applicant: DAIDO STEEL CO., LTD., Nagoya-shi (JP)

(72) Inventors: Yoshihiko Koyanagi, Nagoya (JP); Hiroyuki Takabayashi, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 16/001,810

(22) Filed: Jun. 6, 2018

(65) Prior Publication Data

US 2019/0017132 A1 Jan. 17, 2019

(30) Foreign Application Priority Data

Jul. 14, 2017 (JP) ..... 2017-137812

(51) Int. Cl.

| | |
|---|---|
| ***C22C 38/02*** | (2006.01) |
| ***C22C 38/04*** | (2006.01) |
| ***C22C 38/18*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/48*** | (2006.01) |
| ***C21D 1/28*** | (2006.01) |
| ***C21D 7/02*** | (2006.01) |
| ***C21D 7/13*** | (2006.01) |
| ***C21D 9/02*** | (2006.01) |
| ***C21D 9/46*** | (2006.01) |
| ***C21D 6/00*** | (2006.01) |
| ***C22C 38/00*** | (2006.01) |
| ***C21D 8/00*** | (2006.01) |
| ***C21D 9/00*** | (2006.01) |
| *C22C 38/40* | (2006.01) |
| *C22C 38/20* | (2006.01) |

(52) U.S. Cl.

CPC ..... *C21D 6/008* (2013.01); *C21D 1/28* (2013.01); *C21D 6/002* (2013.01); *C21D 6/004* (2013.01); *C21D 6/005* (2013.01); *C21D 7/02* (2013.01); *C21D 7/13* (2013.01); *C21D 8/005* (2013.01); *C21D 9/0093* (2013.01); *C21D 9/02* (2013.01); *C21D 9/46* (2013.01); *C22C 38/001* (2013.01); *C22C 38/004* (2013.01); *C22C 38/02* (2013.01); *C22C 38/04* (2013.01); *C22C 38/18* (2013.01); *C22C 38/22* (2013.01); *C22C 38/26* (2013.01); *C22C 38/28* (2013.01); *C22C 38/32* (2013.01); *C22C 38/42* (2013.01); *C22C 38/44* (2013.01); *C22C 38/48* (2013.01); *C21D 2211/004* (2013.01); *C21D 2211/005* (2013.01); *C22C 38/20* (2013.01); *C22C 38/40* (2013.01); *F01N 2370/00* (2013.01); *F01N 2530/00* (2013.01); *F01N 2560/00* (2013.01)

(58) Field of Classification Search

CPC ..... C22C 38/02; C22C 38/001; C22C 38/004; C22C 38/04; C22C 38/18; C22C 38/22; C22C 38/26; C22C 38/28; C22C 38/32; C22C 38/42; C22C 38/44; C22C 38/48

USPC ..... 148/325

See application file for complete search history.

(56) References Cited

U.S. PATENT DOCUMENTS

| | | | | |
|---|---|---|---|---|
| 5,152,850 | A * | 10/1992 | Takahashi | C22C 38/24 148/325 |
| 8,790,573 | B2 | 7/2014 | Miyazaki et al. | |
| 2002/0144756 | A1* | 10/2002 | Hirata | C21D 6/002 148/325 |
| 2007/0144634 | A1 | 6/2007 | Miyazaki et al. | |
| 2012/0145285 | A1 | 6/2012 | Hattendorf et al. | |
| 2012/0241052 | A1* | 9/2012 | Kim | C22C 38/001 148/506 |
| 2014/0069619 | A1 | 3/2014 | Hiraide et al. | |

FOREIGN PATENT DOCUMENTS

| | | | |
|---|---|---|---|
| JP | H 08-170155 | A | 7/1996 |
| JP | 2009-174040 | A | 8/2009 |
| JP | 2009-235555 | A | 10/2009 |
| JP | 4604714 | B2 | 1/2011 |
| JP | 201140688 | A | 7/2012 |
| JP | 2012-214881 | A | 11/2012 |
| WO | WO 2012/133506 | A1 | 10/2012 |

OTHER PUBLICATIONS

English language machine translation of JP 2009174040 to Oku et al. Generated Jun. 19, 2019. (Year: 2019).*

European Search Report dated Sep. 5, 2018 for European Patent Application No. 18183302.1-1103.

European Office Action dated Nov. 26, 2019, in European Patent Application No. 18183302.1.

Chinese Office Action dated Apr. 8, 2020, in Chinese Patent Application No. 201810768554.4 with an English translation.

* cited by examiner

*Primary Examiner* — Brian D Walck

(74) *Attorney, Agent, or Firm* — McGinn IP Law Group, PLLC

(57) ABSTRACT

The present invention relates to a ferritic stainless steel according to the present invention, containing, in mass %: 0.001%≤C≤0.020%, 0.05%≤Si≤0.50%, 0.1%≤Mn≤1.0%, 15.0%≤Cr≤25.0%, Mo<0.50%, 0.50%≤W≤5.00%, and 0.01%≤Nb≤0.50%, with a balance being Fe and unavoidable impurities, having a content (coarse Laves phase ratio) of coarse Laves phase having a diameter of 0.50 μm or more being 0.1% or less, and having an average grain size being 30 μm or more and 200 μm or less.

18 Claims, No Drawings

FERRITIC STAINLESS STEEL AND HEAT-RESISTANT MEMBER

TECHNICAL FIELD

The present invention relates to a ferritic stainless steel and a heat-resistant member, and in more detail, relates to a ferritic stainless steel having excellent cold workability and heat resistance, and a heat-resistant member using the same.

BACKGROUND ART

A ferritic stainless steel has excellent oxidation resistance and cold workability, and, on the other hand, its high temperature strength is inferior to that of an austenitic stainless steel. For this reason, the ferric stainless steel is not so much employed as a heat-resistant strength member. As the most common uses, the ferritic stainless steel is used in a muffler, a pipe and the like involving thermal fatigue, utilizing its low coefficient of thermal expansion. Furthermore, a ferritic stainless steel containing Mo and Nb is liable to form Laves phase after melting and casting or when exposed to high temperature. Coarse Laves phase causes deterioration of toughness and workability. To expand uses of the ferritic stainless steel, those problems must be overcome. In view of the above, various proposals have been conventionally made to overcome those problems.

For example, Patent Document 1 discloses a method in which a ferritic Cr-containing steel material containing a predetermined amount of W is subjected to hot rolling, the hot rolled plate is subjected to annealing and cold rolling, followed by finishing annealing at a temperature of 1,020 to 1,200° C.

This Patent Document describes that (A) the amount of W precipitated can be decreased to 0.1% or less by the method and thereby, (B) a coefficient of thermal expansion of an alloy can be remarkably decreased.

Patent Document 2 discloses a method for manufacturing an Nb-containing ferritic stainless steel hot rolled and annealed coil including (a) hot rolling a slab containing an Nb-containing ferritic stainless steel at a finishing rolling temperature of 890° C. or higher, (b) cooling the resulting hot rolled sheet strip with water and taking up the sheet strip at a winding temperature of 400° C. or lower to form a coil, and (c) dipping the coil after taking up at low temperature in water.

This Patent Document describes that (A) brittleness due to the formation of Laves phase and 475° C. brittleness occur by heat recuperation after taking up into the coil even though the sheet strip is merely cooled with water and (B) when the sheet strip is taken up at a temperature of 400° C. or lower and the resulting coil after taking up is dipped in water, heat recuperation and brittleness due to the heat recuperation can be suppressed.

Patent Document 3 discloses a method for manufacturing a heat-resistant ferritic stainless steel sheet, including (a) hot rolling a slab containing a Cu-containing heat-resistant ferritic stainless steel to obtain a hot rolled coil, (b) cold rolling the hot rolled coil, and (c) annealing the cold rolled sheet at a temperature of 980° C. to 1,070° C.

This Patent Document describes that (A) when Cu is added, high temperature strength is improved, but oxidation resistance greatly varies due to slight difference of components, and (B) when components are optimized, the formation of γ phase in a surface layer part during maintaining at high temperature is suppressed, and deterioration of oxidation resistance can be suppressed.

Patent Document 4 discloses a method for manufacturing a ferritic stainless steel including (a) hot rolling a ferritic stainless steel containing 0.3 mass % or more of Nb, (b) cold rolling the hot rolled sheet, and (c) finally annealing the cold rolled sheet at a temperature of 1,000° C. to 1,100° C.

This Patent Document describes that (A) when Ni brazing is applied to a ferritic stainless steel, the material must be exposed to high temperature of 1,100° C. or higher, but at such high temperature, the ferritic stainless steel causes coarsening of grains and toughness is liable to be deteriorated, and (B) when 0.3 mass % or more of Nb is added, coarsening of grains at Ni brazing temperature can be suppressed.

Patent Document 5 discloses a heat-resistant ferritic stainless steel having optimized contents of Al, Ti and Si.

This Patent Document describes that (A) a ferritic stainless steel is easy to cause internal grain boundary oxidation when used at high temperature, and (B) when solute amounts of Al and Ti contained in a ferritic stainless steel are limited and the amount of Si added is increased, internal grain boundary oxidation can be suppressed up to a temperature region of 900° C.

Improvement in heat resistance of a ferritic stainless steel is generally achieved by solid-solution hardening by the addition of Mo, but the addition of Mo in large amount is suppressed from the standpoints of avoiding deterioration of workability and cost reduction. On the other hand, W has been known as an element having the same effect as Mo, and a material in which a part of Mo is substituted with W has been proposed (see Patent Document 1). However, a ferritic stainless steel to which only W was added for the purpose of improving heat resistance has been not almost proposed. This is because solid-solution hardening ability of W is small as compared with that of Mo, and large amount of W must be added in order to obtain the same degree of strength. Furthermore, no ferritic stainless steel substantially containing only W as an element for solid-solution hardening and excellent in cold workability and heat resistance has been conventionally proposed.

Patent Document 1: Japanese Patent No. 4604714
Patent Document 2: JP-A 2012-140688
Patent Document 3: JP-A 2009-235555
Patent Document 4: JP-A 2009-174040
Patent Document 5: JP-A H08-170155

SUMMARY OF THE INVENTION

An object of the present invention is to provide a ferritic stainless steel having excellent cold workability and heat resistance.

Another object of the present invention is to provide a heat-resistant member having excellent high temperature strength.

The present invention has been made to overcome the above-described problems in the prior art.

A ferritic stainless steel according to the present invention, contains, in mass %:

$0.001\% \leq C \leq 0.020\%$,
$0.05\% \leq Si \leq 0.50\%$,
$0.1\% \leq Mn \leq 1.0\%$,
$15.0\% \leq Cr \leq 25.0\%$,
$Mo < 0.50\%$,
$0.50\% \leq W \leq 5.00\%$, and
$0.01\% \leq Nb \leq 0.50\%$, with a balance being Fe and unavoidable impurities, has a content (coarse Laves phase ratio) of coarse Laves phase having a diameter of 0.50 μm or more being 0.1% or less, and has an average grain size being 30 μm or more and 200 μm or less.

A heat-resistant member according to the present invention contains a ferritic stainless steel in which the ferritic stainless steel, contains, in mass %:

0.001%≤C≤0.020%, 0.05%≤Si≤0.50%, 0.1%≤Mn≤1.0%, 15.0%≤Cr≤25.0%,

Mo<0.50%, 0.50%≤W≤5.00%, and 0.01%≤Nb≤0.50%, with a balance being Fe and unavoidable impurities, has a content (coarse Laves phase ratio) of coarse Laves phase having a diameter of 0.50 μm or more being 0.1% or less, has an average grain size being 30 μm or more and 200 μm or less, and has a content (fine Laves phase ratio) of fine Laves phase having a diameter of 0.20 μm or less being 0.05% or more.

W and Mo each has the action of solid-solution hardening a ferritic stainless steel, but simultaneously has the action of forming Laves phase. Coarse Laves phase causes to deteriorate toughness of a material. To extinguish the coarse Laves phase, the ferritic stainless steel must be heat-treated at a temperature higher than the sold-solution temperature of the Laves phase. However, Mo-containing Laves phase has high solid-solution temperature. Therefore, such a ferritic stainless steel must be heat-treated at higher temperature in order to dissolve coarse Laves phase in solid. As a result, grains of the ferritic stainless steel are coarsened. The coarsening of grains causes to deteriorate cold workability.

On the other hand, W-containing Laves phase has low solid-solution temperature as compared with that of Mo-containing Laves phase. As a result, the heat treatment temperature can be decreased, and coarse Laves phase can be extinguished without coarsening grains.

Furthermore, when such a ferritic stainless steel is maintained at appropriate temperature after extinguishing coarse Laves phase, fine Laves phase can be precipitated in grains. Fine Laves phase in an appropriate amount does not cause to deteriorate toughness, and rather contributes to the improvement of high temperature strength in some cases. The precipitation of fine Laves phase is further accelerated by particularly giving appropriate strain during the heat treatment. As a result, heat resistance is enhanced without deteriorating cold workability.

MODE FOR CARRYING OUT THE INVENTION

One embodiment of the present invention will be described in detail below.

1. Ferritic Stainless Steel

The ferritic stainless steel according to the present invention requires the following configuration.

The ferritic stainless steel contains, in mass %:

0.001%≤C≤0.020%, 0.05%≤Si≤0.50%, 0.1%≤Mn≤1.0%, 15.0%≤Cr≤25.0%,

Mo<0.50%, 0.50%≤W≤5.00%, and 0.01%≤Nb≤0.50%, with the balance being Fe and unavoidable impurities.

The ferritic stainless steel has a content (coarse Laves phase ratio) of coarse Laves phase having a diameter of 0.50 μm or more being 0.1% or less.

The ferritic stainless steel has an average grain size being 30 μm or more and 200 μm or less.

1.1 Composition 1.1.1. Main Constituent Elements

The ferritic stainless steel according to the present invention contains the following elements, with the balance being Fe and unavoidable impurities. Kinds of the added elements, the content ranges of the components, and the reasons for limiting those are as follows. The "%" means mass %.

(1) 0.001%≤C≤0.020%

C is a representative solute element. C forms a carbide together with other elements such as Nb and Ti, and has an effect of suppressing growth of grains. To achieve the effect, the C content should be 0.001% or more. The C content is preferably 0.003% or more, and more preferably 0.005% or more.

On the other hand, excessive C content excessively increases matrix strength and as a result, deteriorates cold workability and impact property. For this reason, the C content should be 0.020% or less. The C content is preferably 0.015% or less, and more preferably 0.011% or less.

(2) 0.05%≤Si≤0.50%

Si is effective as a deoxidizing agent. To achieve the effect, the Si content should be 0.05% or more. The Si content is preferably 0.08% or more, and more preferably 0.10% or more.

On the other hand, Si is a representative element for solid-solution hardening. Therefore, excessive Si content excessively increases matrix strength, and as a result, deteriorates cold workability and impact property. For this reason, the Si content should be 0.50% or less. The Si content is preferably 0.40% or less, and more preferably 0.35% or less.

(3) 0.1%≤Mn≤1.0%

Mn has an effect of improving peeling resistance of oxide scale, and therefore, is particularly added in uses of the ferritic stainless steel at high temperature. Furthermore, Mn suppresses grain boundary segregation of S that impairs hot workability, and enhances hot workability. To achieve these effects, the Mn content should be 0.1% or more. The Mn content is preferably 0.20% or more, and more preferably 0.25% or more.

On the other hand, Mn is an element stabilizing austenite. Therefore, excessive Mn content destabilizes ferrite phase. For this reason, the Mn content should be 1.0% or less. The Mn content is preferably 0.80% or less, and more preferably 0.50% or less.

(4) 15.0%≤Cr≤25.0%

Cr is an element stabilizing ferrite phase and contributes to the improvement of corrosion resistance and oxidation resistance. To achieve the effect, the Cr content should be 15.0% or more. The Cr content is preferably 16.0% or more, and more preferably 16.5% or more.

On the other hand, excessive Cr content easily causes the formation of σ phase that is a brittle phase, and deteriorates cold workability and impact property. For this reason, the Cr content should be 25.0% or less. The Cr content is preferably 21% or less, and more preferably 18% or less.

(5) Mo<0.50% (0≤Mo<0.50%)

Mo is an element exhibiting the same effect as W described hereinafter. Mo is an element stabilizing ferrite, and contributes to solid-solution hardening and the improvement of corrosion resistance and oxidation resistance. However, Mo has Laves phase forming ability stronger than that of W, and therefore, Laves phase is precipitated even when small amount of Mo is added. Furthermore, since Mo-containing Laves phase has high solid-solution temperature, to extinguish the Laves phase, the ferritic stainless steel should be heat-treated at higher temperature. For this reason, the Mo content should be less than 0.50%. The Mo content is preferably 0.30% or less, more preferably 0.20% or less, and still more preferably 0.10% or less.

(6) 0.50≤W≤5.00%

W is the most important element in the present invention. W is an element stabilizing ferrite, and contributes to solid-solution hardening and the improvement of corrosion resistance and oxidation resistance. To achieve these effects, the W content should be 0.50% or more. The W content is preferably 1.0% or more and more preferably 1.5% or more.

On the other hand, excessive W content precipitates a large amount of coarse Laves phase. In the present invention, Laves phase has $Fe_2W$ as a basic component, which is partially substituted with Cr or Nb. Laves phase is generally known as a brittle phase, and coarse Laves phase causes to deteriorate cold workability and impact property. For this reason, the W content should be 5.00% or less. The W content is preferably 3.0% or less, and more preferably 2.5% or less.

(7) 0.01≤Nb≤0.50%

Nb has an effect of improving cold workability and impact property. In a ferritic stainless steel, solute C may deteriorates cold workability and impact property. Nb is an element forming a carbide, and therefore fixes C in a material, thereby suppressing C from being dissolved in a matrix. To achieve these effects, the Nb content should be 0.01% or more. The Nb content is preferably 0.05% or more, and more preferably 0.10% or more.

On the other hand, excessive Nb content forms coarse carbide and Laves phase and may adversely affect cold workability and impact property. For this reason, the Nb content should be 0.50% or less. The Nb content is preferably 0.45% or less, and more preferably 0.40% or less.

1.1.2. Sub-constituent elements

The ferritic stainless steel according to the present invention may further contain at least one of the following elements in addition to the main constituent elements described above. Kinds of the added elements, the content ranges of the components, and the reasons for limiting those are as follows. The "%" means mass %.

(8) 0.1%≤Cu≤2.0%

Cu is an element improving low temperature toughness, and further contributes to the improvement of high temperature strength through the precipitation of Cu at high temperature region. To achieve these effects, the Cu content is preferably 0.1% or more, more preferably 0.2% or more, and still more preferably 0.50% or more.

On the other hand, Cu is an element stabilizing austenite. Therefore, excessive Cu content destabilizes ferrite phase. Additionally, excessive Cu content deteriorates hot workability and oxidation resistance. For this reason, the Cu content is preferably 2.0% or less, more preferably 1.8% or less, and still more preferably 1.5% or less.

(9) 0.1%≤Ni≤2.0%

Ni is an element improving low temperature toughness similar to Cu. To achieve the effect, the Ni content is preferably 0.1% or more, more preferably 0.2% or more and still more preferably 0.5% or more.

On the other hand, Ni is an element stabilizing austenite. Therefore, excessive Ni content destabilizes ferrite phase. Additionally, excessive Ni content deteriorates hot workability and oxidation resistance. For this reason, the Ni content is preferably 2.0% or less, more preferably 1.8% or less, and still more preferably 1.5% or less.

Any one of Cu and Ni may be added, and both Cu and Ni may be added.

(10) 0.001%≤Al≤0.50%

Al is effective as a deoxidizing agent. To achieve the effect, the Al content is preferably 0.001% or more, more preferably 0.002% or more, and still more preferably 0.003% or more.

On the other hand, excessive Al content has the problems such that embrittlement is accelerated, and aluminum nitride is formed, resulting in the starting point of destruction. For this reason, the Al content is preferably 0.50% or less, more preferably 0.30% or less, and still more preferably 0.10% or less.

(11) 0.01%≤Ti≤0.50%

Ti has an effect of improving cold workability and impact property. In a ferritic stainless steel, solute C may deteriorates cold workability and impact property. Ti is an element forming a carbide, and therefore fixes C in a material, thereby suppressing C from being dissolved in a matrix. To achieve these effects, the Ti content is preferably 0.01% or more, more preferably 0.05% or more, and still more preferably 0.10% or more.

On the other hand, excessive Ti content forms coarse carbide and may adversely affect cold workability and impact property. For this reason, the Ti content is preferably 0.50% or less, more preferably 0.40% or less, and still more preferably 0.30% or less.

(12) 0.01%≤Ta≤0.50%

Ta has an effect of improving cold workability and impact property. In a ferritic stainless steel, solute C may deteriorate cold workability and impact property. Ta is an element forming carbide, and therefore fixes C in a material, thereby suppressing C from being dissolved in a matrix. To achieve these effects, the Ta content is preferably 0.01% or more, more preferably 0.05% or more, and still more preferably 0.10% or more.

On the other hand, excessive Ta content forms coarse carbide and may adversely affect cold workability and impact property. For this reason, the Ta content is preferably 0.50% or less, more preferably 0.40% or less, and still more preferably 0.30% or less.

Any one of Ti and Ta may be added, and both Ti and Ta may be added.

(13) 0.0001%≤B≤0.0080%

B is an element effective to secure hot workability. To achieve the effect, the B content is preferably 0.0001% or more, more preferably 0.0003% or more, and still more preferably 0.0005% or more.

On the other hand, excessive B content rather deteriorates hot workability. For this reason, the B content is preferably 0.0080% or less, more preferably 0.0060% or less, and still more preferably 0.0050% or less.

(14) 0.0005%≤Mg≤0.0100%

Mg is an element effective to secure hot workability similar to B. To achieve the effect, the Mg content is preferably 0.0005% or more, more preferably 0.0010% or more, and still more preferably 0.0015% or more.

On the other hand, in the case where Mg is added in an amount more than necessary, the effect of improving hot workability is saturated, and there is no practical benefit. For this reason, the Mg content is preferably 0.0100% or less, more preferably 0.0080% or less, and more preferably 0.0050% or less.

(15) 0.0005%≤Ca≤0.0100%

Ca is an element effective to secure hot workability similar to B and Mg. To achieve the effect, the Ca content is preferably 0.0005% or more, more preferably 0.0010% or more, and still more preferably 0.0015% or more.

On the other hand, in the case where Ca is added in an amount more than necessary, the effect of improving hot workability is saturated, and there is no practical benefit. For this reason, the Ca content is preferably 0.0100% or less, more preferably 0.0080% or less, and more preferably 0.0050% or less.

Any one of B, Mg and Ca may be added, and at least two of them may be added.

1.1.3. Unavoidable Impurities

Elements that are unavoidable impurities and the contents thereof should be limited are as follows. The "%" means mass %.

(16) P≤0.050% (0≤P≤0.050%)

P is an element for solid-solution hardening. Therefore, excessive P content excessively increases matrix strength and deteriorates cold workability and impact property. For this reason, the P content is preferably 0.050% or less, more preferably 0.040% or less, and still more preferably 0.035% or less.

(17) O≤0.0300% (0≤O≤0.0300%)

Excessive O content accelerates the formation of an oxide and deteriorates workability. For this reason, the O content is preferably 0.0300% or less, more preferably 0.0200% or less, and still more preferably 0.0150% or less.

(18) N≤0.0350% (0≤N≤0.0350%)

Excessive N content results in the formation of hard nitride and deteriorates workability. For this reason, the N content is preferably 0.0350% or less, more preferably 0.0300% or less, and still more preferably 0.0250% or less.

1.1.4. Solid-solution Temperature of Laves Phase

In ferritic stainless steel, Laves phase is easy to be precipitated during melting and casting. The solid-solution temperature of the Laves phase precipitated is unequivocally determined depending on the composition of the whole steel. As the solid-solution temperature of Laves phase is increased, the temperature at the heat treatment necessary to extinguish coarse Laves phase is increased and grains are easily coarsened. To extinguish coarse Laves phase without coarsening grains, the solid-solution temperature of the Laves phase is preferably 950° C. or lower, more preferably 930° C. or lower, and still more preferably 900° C. or lower.

1.2. Content of Coarse Laves Phase (Coarse Laves Phase Ratio)

W has small solid-solution hardening ability as compared with that of Mo. Therefore, to achieve the effect equal to or more than that of Mo-added steel, a large amount of W must be added. However, in the case where a large amount of W is added, Laves phase is easy to be precipitated during melting and casting. Coarse Laves phase causes the deterioration of impact value and workability. For this reason, coarse Laves phase is extinguished by heat treatment in the present invention as described below. In the case where the heat treatment is not sufficient, coarse Laves phase remains, and impact value and workability are not sufficiently improved.

To achieve high impact value and workability, the content (coarse Laves phase ratio) of coarse Laves phase should be 0.10% or less. The coarse Laves phase ratio is preferably 0.08% or less, and more preferably 0.05% or less.

The term "coarse Laves phase" used herein means Laves phase having a diameter of 0.50 μm or more.

The term "coarse Laves phase ratio" used herein means the proportion of weight of coarse Laves phase to the whole weight of the ferritic stainless steel.

1.3. Average Grain Size

In general, if an average grain size excessively increases, cold workability is deteriorated. This is because a ferritic stainless steel is difficult to be uniformly deformed during cold working as grains become coarser. In Mo-added steel, a solid-solution temperature of Laves phase is high. Therefore, to extinguish Laves phase, the Mo-added steel must be heat-treated at higher temperature. As a result, grains are easy to coarsen. On the other hand, in W-added steel, a solid-solution temperature of Laves phase is relatively low. Therefore, Laves phase can be extinguished without coarsening grains.

To suppress the deterioration of cold workability, the average grain size of the ferritic stainless steel should be 200 μm or less. The average grain size is preferably 150 μm or less, and more preferably 100 μm or less.

On the other hand, in the case where the average grain size is excessively small, high temperature strength may be deteriorated when the ferritic stainless steel is used in high temperature environment. For this reason, the average grain size of the ferritic stainless steel is preferably 30 μm or more, more preferably 40 μm or more, and still more preferably 50 μm or more.

The term "average grain size" used herein means an average value of five values of particle size of grains contained in observation fields when observing five visual fields randomly selected, in 100 magnifications.

The term "particle size of grains" used herein means an average value of a major axis size and a minor axis size of grains.

1.4. Strain

When coarse Laves phase is dissolved in a matrix and the steel is then exposed to a predetermined temperature, fine Laves phase is precipitated in grains. The fine Laves phase has an action of improving high temperature strength, particularly creep property. Such precipitation of fine Laves phase is accelerated by introducing strain. In general, precipitation of fine Laves phase is accelerated as the introduction amount of strain increases.

To obtain a ferritic stainless steel having excellent heat resistance, the introduction amount of strain is preferably 0.01 or more, more preferably 0.05 or more, and still more preferably 0.10 or more.

On the other hand, in the case where the introduction amount of strain is excessive, Laves phase is coarsened in high temperature environment, and fine Laves phase contributing to high temperature strength may not be obtained. For this reason, the introduction amount of strain is preferably 0.50 or less, more preferably 0.40 or less, and still more preferably 0.30 or less.

The term "introduction amount of strain" used herein means plastic strain amount calculated by using crystal orientation data obtained by Electron Backscatter Diffraction (EBSD).

1.5. Content of Fine Laves Phase (Fine Laves Phase Ratio)

As described above, fine Laves phase has the action of improving high temperature strength, particularly creep property. To obtain a ferritic stainless steel having excellent heat resistance, the content (fine Laves phase ratio) of fine Laves phase is preferably 0.05% or more, more preferably 0.10% or more, and still more preferably 0.20% or more.

On the other hand, excessive fine Laves phase ratio may accelerate brittleness. For this reason, the fine Laves phase ratio is preferably 1.00% or less, more preferably 0.80% or less, and still more preferably 0.50% or less.

The term "fine Laves phase" used herein means Laves phase having a diameter of 0.20 μm or less.

The term "fine Laves phase ratio" used herein means the proportion of weight of fine Laves phase to the whole weight of the ferritic stainless steel.

1.6. Uses

The ferritic stainless steel according to the present invention is suitable for use as a material of a member used in a temperature region of 500° C. to 700° C. The temperature region of 500° C. to 700° C. corresponds to a precipitation temperature region of fine Laves phase. Therefore, when a ferritic stainless steel in which coarse Laves phase has been extinguished is used in this temperature region, fine Laves phase is precipitated and heat resistance is improved. Furthermore, when appropriate stress is applied at this time, fine Laves phase is preferentially precipitated in a stress concentration portion, and as a result, creep property is improved.

2. Method for Manufacturing Ferritic Stainless Steel

The ferritic stainless steel according to the present invention can be manufactured by (a) melting and casting raw materials blended so as to have a predetermined composition to obtain an ingot, (b) hot-working the ingot obtained to obtain a steel material, (c) cold-working the steel material after hot working as necessary, and (d) annealing the steel material after hot working or cold working, thereby extinguishing coarse Laves phase.

2.1. Melting and Casting Step

Raw materials blended so as to have a predetermined composition are melted and cast to obtain an ingot (melting and casting step). In the present invention, the method and conditions of melting and casting are not particularly limited, and various methods and conditions can be selected depending on purposes.

2.2. Hot Working Step

The ingot obtained is hot-worked (hot working step). The hot working is conducted to destroy cast structure and to obtain a steel material having a desired shape. The method and conditions of hot working are not particularly limited, and various methods and conditions can be selected depending on purposes.

2.3. Cold Working Step

As necessary, the steel material after hot working is further cold-worked (cold working step). The cold working is conducted to obtain a steel material having a desired shape and size. The method and conditions of cold working are not particularly limited, and various methods and conditions can be selected depending on purposes.

2.4. Annealing Step

The steel material after hot working or cold working is annealed (annealing step). The annealing is conducted to extinguish coarse Laves phase. In the case where the annealing temperature is too low, a large amount of coarse Laves phase remains, resulting in deterioration of cold workability and impact property. For this reason, the annealing temperature is preferably (solid solution temperature of Laves phase −15)° C. or higher, more preferably (solid solution temperature of Laves phase −10)° C. or higher, and still more preferably (solid solution temperature of Laves phase −5)° C. or higher.

On the other hand, in the case where the annealing temperature is too high, grains are coarsened. For this reason, the annealing temperature is preferably (solid solution temperature of Laves phase +50)° C. or lower, more preferably (solid solution temperature of Laves phase +30)° C. or lower, and still more preferably (solid solution temperature of Laves phase +15)° C. or lower.

The annealing time can be selected appropriately depending on the annealing temperature. In general, coarse Laves phase can be extinguished in a short period of time as the annealing temperature increases. The optimum annealing time is generally 1 to 8 hours, although varying depending on the material composition, annealing time and the like.

2.5. Post-step 2.5.1. Strain Introduction Treatment

The steel material after annealing may be further subjected to a strain introduction treatment, as necessary. The method and conditions of the strain introduction treatment are not particularly limited, and various methods and conditions can be selected depending on purposes. Examples of the strain introduction method include (a) cold or hot rolling or swaging, (b) cold or hot die forging, and (c) cold or hot form rolling (bolt shaping, etc.).

2.5.2. Precipitation Treatment

The steel material after annealing or the steel material after the strain introduction treatment may be subjected to a treatment for precipitating fine Laves phase. In the case where the precipitation treatment temperature is too low, fine Laves phase is not sufficiently precipitated. For this reason, the precipitation treatment temperature is preferably 500° C. or higher, more preferably 550° C. or higher, and still more preferably 600° C. or higher.

On the other hand, in the case where the precipitation treatment temperature is too high, Laves phase may be coarsened. For this reason, the precipitation treatment temperature is preferably 700° C. or lower, more preferably 680° C. or lower, and still more preferably 650° C. or lower.

The precipitation treatment time can be selected appropriately depending on the precipitation treatment temperature. In general, a large amount of fine Laves phase can be precipitated in a short period of time as the precipitation treatment temperature increases. The optimum precipitation treatment time is generally 4 to 96 hours, although varying depending on the material composition, strain introduction amount and the like.

3. Heat-resistant Member

The heat-resistant member according to the present invention contains the ferritic stainless steel according to the present invention. The shape, working temperature and the like of the heat-resistant member are not particularly limited. The details of the ferritic stainless steel are already described above, and the description thereof is omitted.

4. Action

Ceramic element having small coefficient of thermal expansion has been conventionally used on $O_2$ sensor and A/F sensor of automobiles. Therefore, a ferritic stainless steel (SUS430) having small coefficient of thermal expansion is generally used in a housing of these sensors. However, in recent years, the number of sensors used for controlling combustion mode of automobiles tends to increase, and exhaust gas temperature also tends to increase for the purpose of improving combustion efficiency. Higher heat resistance is getting to be required in a housing of the sensors with the increase of the exhaust gas temperature, and durability of the current SUS430 is not sufficient in the present situation. On the other hand, considering productivity, cold workability is also required. That is, both heat resistance and cold workability are required in the material used in a housing of a sensor.

Heat resistance of the ferritic stainless steel is generally improved through solid-solution hardening by the addition of Mo. However, in the Mo-added steel, coarse Laves phase deteriorating cold workability remains when the annealing temperature is not sufficiently high. Thus, there has been a restriction on production. Additionally, the high temperature annealing treatment coarsens grains, and therefore adversely affects cold workability.

On the other hand, W has been known as an element having the same effect as Mo. However, there has been substantially no proposal of a ferritic stainless steel having W alone added thereto. This is because the solid-solution hardening ability of W is small as compared with that of Mo, and a large amount of W must be added in order to achieve the strength equal to that of the Mo-added steel.

In view of the above, the present inventors have made investigations in detail on the difference between W and Mo. As a result, they found that (a) Mo is easy to precipitate coarse Laves phase that is a brittle phase, as compared with W, (b) Laves phase affects cold workability and impact property, (c) fine Laves phase rather improves creep property, and (d) cold workability, impact property and creep property can be simultaneously improved by suppressing precipitation of coarse Laves phase.

Specifically, the present inventors focused on W that contributes to the improvement of high temperature strength and has low solid-solution temperature of Laves phase on the basis of SUS430 (not containing Mo and W) in order to achieve both heat resistance and cold workability, and they investigated the optimization. Furthermore, they have added Nb for suppressing coarsening of grains and for trapping solute carbon and optimized such that high temperature strength can be maintained. As a result, a ferritic stainless steel having both excellent cold workability and high temperature strength and showing excellent property balance as compared with that of the conventional heat-resistant ferritic stainless steel has been obtained.

The ferritic stainless steel according to the present invention has low solid-solution temperature of Laves phase, and therefore can extinguish coarse Laves phase without coarsening grains. Furthermore, when the ferritic stainless steel is maintained at an appropriate temperature after extinguishing coarse Laves phase, fine Laves phase can be precipitated in grains. Fine Laves phase does not cause deterioration of toughness, and rather sometimes contributes to the improvement of high temperature strength. Such precipitation of fine Laves phase is further accelerated particularly when appropriate strain is given during heat treatment. As a result, heat resistance is improved without impairing cold workability.

The ferritic stainless steel according to the present invention can be used in various uses, not only in a housing of a sensor. For example, a heat-resistant bolt is obtained by shaping a material into a predetermined shape by cold working and then used at high temperature. For the heat-resistant bolt, an austenitic stainless steel has been usually employed. However, the austenitic stainless steel represented by SUS304 hardens during cold working, and therefore, deformation resistance is large. Furthermore, the austenitic stainless steel has a large coefficient of thermal expansion, which tends to cause loosening or clearance when fastening the bolt.

On the other hand, the ferritic stainless steel according to the present invention has a small coefficient of thermal expansion. Therefore, loosening and clearance due to increase and decrease of a temperature hardly occur. Furthermore, because cold workability is excellent, the life of mold is prolonged. Additionally, because Laves phase is utilized, relaxation property required in a bold is also high. The ferritic stainless steel according to the present invention can be also used in disc spring, leaf spring and the like used at high temperature.

EXAMPLES

Examples 1 to 23 and Comparative Examples 1 to 5

1. Preparation of Sample

Raw materials were melted to prepare 150 kg ingots each having a chemical component shown in Table 1 in a vacuum induction furnace. The resulting ingot was hot-forged to prepare a bar of 25 mm square. To dissolve coarse Laves phase in solid, the bar was maintained at 900° C. for 4 hours, and then air-cooled. Materials having a solid-solution temperature of Laves phase being 900° C. or higher were further annealed at a temperature of (solid-solution temperature of Laves phase +30)° C.

TABLE 1

| | Chemical component (mass %) | | | | | | | | | | | | |
|---|---|---|---|---|---|---|---|---|---|---|---|---|---|
| | C | Si | Mn | Fe | Cr | Ni | Cu | Mo | W | Nb | Ti | N | B |
| Example 1 | 0.006 | 0.30 | 0.30 | Bal. | 15.4 | — | — | 0.01 | 1.97 | 0.34 | — | 0.017 | — |
| Example 2 | 0.008 | 0.31 | 0.29 | Bal. | 17.1 | — | — | 0.02 | 0.58 | 0.34 | — | 0.018 | — |
| Example 3 | 0.009 | 0.32 | 0.29 | Bal. | 16.9 | — | — | 0.03 | 0.98 | 0.34 | — | 0.017 | — |
| Example 4 | 0.008 | 0.30 | 0.30 | Bal. | 17.0 | — | — | 0.01 | 1.40 | 0.34 | — | 0.016 | — |
| Example 5 | 0.010 | 0.31 | 0.31 | Bal. | 16.8 | — | — | 0.02 | 2.01 | 0.35 | — | 0.018 | — |
| Example 6 | 0.007 | 0.31 | 0.29 | Bal. | 16.5 | — | — | 0.01 | 3.03 | 0.35 | — | 0.016 | — |
| Example 7 | 0.005 | 0.30 | 0.30 | Bal. | 17.2 | — | — | 0.02 | 3.46 | 0.37 | — | 0.018 | — |
| Example 8 | 0.012 | 0.30 | 0.31 | Bal. | 17.1 | — | — | 0.01 | 3.99 | 0.35 | — | 0.017 | — |
| Example 9 | 0.008 | 0.31 | 0.30 | Bal. | 20.3 | — | — | 0.01 | 1.02 | 0.35 | — | 0.018 | — |
| Example 10 | 0.008 | 0.31 | 0.30 | Bal. | 20.1 | — | — | 0.02 | 2.02 | 0.35 | — | 0.016 | — |
| Example 11 | 0.008 | 0.30 | 0.30 | Bal. | 21.2 | — | — | 0.01 | 3.03 | 0.37 | — | 0.018 | — |
| Example 12 | 0.008 | 0.30 | 0.29 | Bal. | 19.8 | — | — | 0.01 | 3.98 | 0.33 | — | 0.016 | — |
| Example 13 | 0.007 | 0.30 | 0.30 | Bal. | 18.2 | — | — | 0.02 | 2.00 | 0.35 | — | 0.017 | — |
| Example 14 | 0.009 | 0.31 | 0.29 | Bal. | 19.1 | — | — | 0.01 | 1.99 | 0.34 | — | 0.017 | — |
| Example 15 | 0.008 | 0.31 | 0.30 | Bal. | 24.8 | — | — | 0.01 | 1.98 | 0.34 | — | 0.016 | — |
| Example 16 | 0.007 | 0.30 | 0.29 | Bal. | 17.1 | — | — | 0.02 | 2.00 | 0.48 | — | 0.016 | — |
| Example 17 | 0.006 | 0.30 | 0.30 | Bal. | 17.1 | 0.48 | — | 0.01 | 2.01 | 0.35 | — | 0.016 | — |
| Example 18 | 0.006 | 0.30 | 0.31 | Bal. | 17.0 | 1.12 | — | 0.01 | 2.00 | 0.35 | — | 0.018 | — |
| Example 19 | 0.008 | 0.31 | 0.30 | Bal. | 16.8 | — | 0.41 | 0.02 | 1.98 | 0.35 | — | 0.016 | — |
| Example 20 | 0.008 | 0.29 | 0.29 | Bal. | 17.2 | — | 1.12 | 0.01 | 1.99 | 0.50 | — | 0.017 | — |
| Example 21 | 0.009 | 0.30 | 0.29 | Bal. | 17.0 | 0.51 | 0.48 | 0.02 | 2.02 | 0.35 | — | 0.018 | — |

TABLE 1-continued

| | Chemical component (mass %) | | | | | | | | | | | | |
|---|---|---|---|---|---|---|---|---|---|---|---|---|---|
| | C | Si | Mn | Fe | Cr | Ni | Cu | Mo | W | Nb | Ti | N | B |
| Example 22 | 0.007 | 0.30 | 0.30 | Bal. | 17.0 | — | — | 0.02 | 1.99 | 0.21 | 0.10 | 0.016 | — |
| Example 23 | 0.008 | 0.30 | 0.30 | Bal. | 17.1 | — | — | 0.02 | 2.00 | 0.34 | — | 0.017 | 0.004 |
| Comparative Example 1 | 0.012 | 0.35 | 0.53 | Bal. | 16.8 | — | — | — | — | — | — | 0.016 | — |
| Comparative Example 2 | 0.008 | 0.18 | 0.31 | Bal. | 17.1 | — | — | — | 0.34 | — | — | — | — |
| Comparative Example 3 | 0.009 | 0.20 | 0.32 | Bal. | 19.7 | — | — | 2.01 | — | 0.35 | — | 0.016 | — |
| Comparative Example 4 | 0.011 | 0.18 | 0.32 | Bal. | 17.3 | — | — | 1.10 | 1.46 | 0.34 | — | 0.018 | — |
| Comparative Example 5 | 0.008 | 0.24 | 0.38 | Bal. | 17.2 | — | — | — | 1.98 | 0.78 | — | 0.016 | — |

2. Test Method 2.1. Grain Size

Vertical cross-section (a position corresponding to ¼ width) of the bar after annealing was etched with nital. The vertical cross-section was observed with an optical microscope, and five visual fields thereof were photographed in 100 magnifications. Major axis size and minor axis size of grains contained in each visual field were measured, and its average value was defined as a grain size.

2.2. Laves Phase Ratio

The bar after annealing was subjected to electrolytic extraction using an acetyl acetone aqueous solution, and the residue was collected. In the electrolytic extraction, carbides such as NbC are also extracted in addition to Laves phase. Therefore, phase ratio was derived from a half width of diffraction peak by XRD, a product obtained by multiplying the phase ratio by a weight of the residue was used as a weight of Laves phase, and total Laves phase ratio was calculated by using the weight.

The residue obtained was observed with SEM in 10,000 magnifications five times (five visual fields). A hundred Laves phases were randomly selected from Laves phases contained in each visual field, the major axis size and minor axis size of each Laves phase were measured, and its average (([major axis size+minor axis size]/2) was defined as a diameter of Laves phase. Of those Laves phases, Laves phases having the diameter of 0.20 μm or less were classified as fine Laves phase, Laves phases having the diameter of more than 0.20 μm and less than 0.50 μm were classified as middle Laves phase, and Laves phases having the diameter of 0.50 μm or more were classified as coarse Laves phase.

In addition, volumes of virtual spheres having the respective diameters were calculated, and the total of the volumes of the virtual spheres was calculated as the total volume of Laves phases. Volume ratio of coarse Laves phase to the total volume was multiplied by the total Laves phase ratio to calculate as coarse Laves phase ratio.

Similarly, volume ratio of fine Laves phase to the total volume was multiplied by the total Laves phase ratio to calculate as fine Laves phase ratio.

The Laves phase ratio was evaluated after annealing and after creep test. Regarding the evaluation after creep test, the creep test was terminated at the time when creep strain reached 1.0%, and the electrolytic extraction was conducted by using a parallel part of a test piece.

2.3. Cold Workability

Five compression test pieces having a size of 15 mm diameter×22.5 mm were prepared from each of materials after annealing, and were subjected to a compression test. The compression test was conducted in a strain rate of 6 $s^{-1}$ at room temperature (23° C.). The state of crack and wrinkle on the surface was evaluated in a draft of 70%.

2.4. Impact Property

According to JIS Z2242 (2005), a V notch test peace having a depth of 2 mm was prepared from the material after annealing, and was subjected to Sharpy impact test. The impact test was conducted in 5° C. intervals from room temperature (23° C.) to the maximum 80° C., and a temperature of the lower limit at which impact value of 15 J/$cm^2$ or more was obtained was defined as evaluation standard of the impact value. The impact property is high as the temperature of the lower limit is low.

2.5. Creep Property

A creep test piece was prepared from the material after annealing, and was subjected to a creep test under the condition of 650° C./80 MPa. The creep property was evaluated by the time period with which creep strain reaches 1.0%. The creep property is high as the arrival time is long.

3. Results 3.1. Properties of Materials Annealed at 900° C.

Properties of the materials heat-treated at 900° C. are shown in Table 2. In Table 2, coarse Laves phase ratio is a value after annealing (before creep test), and fine Laves phase ratio is a value after a creep test.

The Laves phase solid-solution temperature in Table 2 is a value measured by an X-ray diffraction analysis. Specifically, a sample in which a Laves phase had been precipitated was subjected to a heat treatment at a temperature from 800° C. to 1,000° C. and then, cooled. The heat treatment was performed by changing heating temperature by 10° C. After that, the X-ray diffraction analysis was performed at room temperature (23° C.), and the lowest heating temperature at which diffraction peak of Laves phase disappeared was defined as the Laves phase solid-solution temperature.

The following facts are understood from Table 2.

(1) In Examples 1 to 23, the solid-solution temperature of Laves phase is generally low. As a result, even when the annealing temperature is 900° C., Laves phase almost completely dissolved in solid and coarsening of grain size was suppressed. Furthermore, cold workability, impact property and creep property were satisfactory. In some Examples, Laves phase did not completely dissolved in solid at 900° C. However, because only W was added, coarse Laves phase ratio was small, and the influence to properties was small.

(2) Samples having coarse Laves phase dissolved in solid showed satisfactory creep property. This is because fine Laves phase precipitates during the creep test (particularly, fine Laves phase precipitates as that strain introduced during the creep test is a priority precipitation site).

(3) In Examples 19, 20 and 21 in which Cu was added, creep property was particularly high. This is because Cu finely precipitates during the creep test, in addition to fine Laves phase.

(4) Comparative Example 1 corresponds to SUS430. Coarse Laves phase did not precipitate, but creep property was poor. In Comparative Example 2, the amount of W added was small. Therefore, cold workability and impact property were satisfactory, but creep property was poor.

(5) Comparative Example 3 corresponds to SUS444, and Mo was added for increasing high temperature strength. In Comparative Example 4, Mo and W were added. Creep property of these Comparative Examples was high, but coarse Laves phase remained at the annealing temperature of 900° C. As a result, cracks were generated during cold working. Furthermore, impact property was not always satisfactory.

(6) In Comparative Example 5, a large amount of Nb was added. Therefore, large amounts of NbC carbide and coarse Laves phase were present, and cold workability was poor.

(7) When the production conditions are optimized, a material in which the temperature of the lower limit at which impact value of 15 J/cm$^2$ or more is obtained is 40° C. or lower and the time at which creep strain reaches 1.0% when a creep test is conducted under the condition of 650° C./80 MPa is 160 hours or more can be obtained.

(8) The temperature of the creep test was lower than the annealing temperature. Therefore, fine Laves phase precipitated during the creep test, but coarse Laves phase did not precipitate. For this reason, in the comparison before and after the creep test, fine Laves phase ratio increased, and as a result, coarse Laves phase ratio relatively decreased. Additionally, an average grain size did not increase during the creep test. It was therefore understood that Examples 1 to 23 satisfy the requirement of coarse Laves phase ratio and the requirement of an average grain size even after the creep test.

3.2. Properties of materials annealed at (solid-solution temperature +30)° C.

The solid-solution temperature of Laves phase was 900° C. or higher in some Examples and Comparative Examples (Examples 7, 8, 11, 12 and 16, and Comparative Examples 3 to 5). Therefore, to almost completely dissolve coarse Laves phase in solid, the annealing treatment was conducted at (solid-solution temperature of Laves phase +30)° C., and properties were evaluated. The results obtained are shown in Table 3. The following facts are understood from Table 3.

(1) In Examples 7, 8, 11, 12 and 16, impact property was slightly deteriorated, but cold workability was improved and creep property was satisfactory.

(2) On the other hand, in Comparative Examples 3 to 5, when the annealing temperature was increased, coarse Laves phase was almost completely dissolved in solid, but grains were coarsened. As a result, cold workability was slightly improved, but impact property was deteriorated.

TABLE 2

| | Laves phase | | Microstructure | | Mechanical properties | | | |
|---|---|---|---|---|---|---|---|---|
| | solid-solution temperature (° C.) | Annealing temperature (° C.) | Coarse Laves phase ratio (%) | Grain size (μm) | Cold workability (Crack/wrinkle) | Impact property (° C.) | Creep property (hr) | Fine Laves phase ratio (%) |
| Example 1 | 860 | 900 | <0.01 | 46 | None | 35 | 158 | 0.25 |
| Example 2 | 810 | 900 | <0.01 | 87 | None | 30 | 128 | 0.08 |
| Example 3 | 820 | 900 | <0.01 | 65 | None | 35 | 135 | 0.12 |
| Example 4 | 840 | 900 | <0.01 | 48 | None | 35 | 169 | 0.13 |
| Example 5 | 850 | 900 | <0.01 | 57 | None | 40 | 180 | 0.22 |
| Example 6 | 900 | 900 | 0.01 | 54 | None | 40 | 176 | 0.28 |
| Example 7 | 920 | 900 | 0.08 | 53 | Wrinkle | 45 | 168 | 0.21 |
| Example 8 | 930 | 900 | 0.08 | 51 | Wrinkle | 45 | 162 | 0.45 |
| Example 9 | 820 | 900 | <0.01 | 66 | None | 30 | 134 | 0.13 |
| Example 10 | 860 | 900 | <0.01 | 66 | None | 40 | 176 | 0.21 |
| Example 11 | 900 | 900 | 0.02 | 61 | Wrinkle | 40 | 178 | 0.28 |
| Example 12 | 940 | 900 | 0.09 | 57 | Wrinkle | 40 | 172 | 0.43 |
| Example 13 | 860 | 900 | <0.01 | 66 | None | 40 | 182 | 0.23 |
| Example 14 | 860 | 900 | <0.01 | 62 | None | 45 | 182 | 0.22 |
| Example 15 | 870 | 900 | <0.01 | 59 | None | 40 | 181 | 0.26 |
| Example 16 | 920 | 900 | 0.02 | 52 | Wrinkle | 40 | 174 | 0.35 |
| Example 17 | 850 | 900 | <0.01 | 62 | None | 25 | 173 | 0.24 |
| Example 18 | 840 | 900 | <0.01 | 68 | None | <Room temperature | 170 | 0.22 |
| Example 19 | 850 | 900 | <0.01 | 64 | None | 25 | 193 | 0.26 |
| Example 20 | 850 | 900 | <0.01 | 71 | None | <Room temperature | 203 | 0.28 |
| Example 21 | 860 | 900 | <0.01 | 68 | None | <Room temperature | 201 | 0.27 |
| Example 22 | 840 | 900 | <0.01 | 55 | None | 40 | 177 | 0.25 |
| Example 23 | 850 | 900 | <0.01 | 55 | None | 40 | 183 | 0.22 |
| Com. Ex. 1 | No precipitation | 750 | — | 89 | None | 30 | 5 | — |
| Com. Ex. 2 | 810 | 900 | <0.01 | 104 | None | 30 | 23 | 0.03 |
| Com. Ex. 3 | 930 | 900 | 0.17 | 67 | Crack | 60 | 177 | 0.46 |
| Com. Ex. 4 | 960 | 900 | 0.18 | 68 | Crack | 65 | 165 | 0.23 |
| Com. Ex. 5 | 950 | 900 | 0.21 | 68 | Crack | 70 | 178 | 0.37 |

*Impact property: Lower limit of temperature at which impact value of 15 J/cm$^2$ or more is obtained.

*Creep property: Time period when strain reached 1.0%.

TABLE 3

| | Laves phase | | Microstructure | | Mechanical properties | | | |
|---|---|---|---|---|---|---|---|---|
| | solid-solution temperature (° C.) | Annealing temperature (° C.) | Coarse Laves phase ratio (%) | Grain size (μm) | Cold workability (Crack/wrinkle) | Impact property (° C.) | Creep property (hr) | Fine Laves phase ratio (%) |
| Example 7 | 920 | 950 | <0.01 | 123 | Wrinkle | 45 | 187 | 0.31 |
| Example 8 | 930 | 960 | <0.01 | 84 | Wrinkle | 45 | 183 | 0.48 |
| Example 11 | 900 | 930 | <0.01 | 101 | Wrinkle | 45 | 197 | 0.34 |
| Example 12 | 940 | 970 | <0.01 | 137 | Wrinkle | 45 | 203 | 0.57 |
| Example 16 | 920 | 950 | <0.01 | 131 | Wrinkle | 45 | 189 | 0.40 |
| Comp. Ex. 3 | 930 | 960 | <0.01 | 246 | Wrinkle | 50 | 203 | 0.57 |
| Comp. Ex. 4 | 960 | 990 | <0.01 | 201 | Wrinkle | 55 | 257 | 0.67 |
| Comp. Ex. 5 | 950 | 980 | <0.01 | 220 | Crack | 60 | 225 | 0.47 |

*Impact property: Lower limit of temperature at which impact value of 15 J/cm$^2$ or more is obtained.
*Creep property: Time period when strain reached 1.0%.

It was understood from the above that in Examples 1 to 23 in which the solid-solution temperature of Laves phase was low, the balance between workability and high temperature property was satisfactory.

On the other hand, it was understood that in Comparative Examples 3 to 5, because the solid-solution temperature of Laves phase was high, residual coarse Laves phase deteriorated cold workability when the annealing temperature was low; whereas coarse Laves phase dissolved in solid when the annealing temperature was high, but grains were coarsened, and as a result, impact property was deteriorated.

Although the embodiments of the present invention have been described in detail, the present invention is not limited to those embodiments and various modifications or changes can be made within the scope that does not depart the gist of the present invention.

The present application is based on Japanese Patent Application No. 2017-137812 filed on Jul. 14, 2017, which content is incorporated herein by reference.

INDUSTRIAL APPLICABILITY

The ferritic stainless steel according to the present invention can be used in a heat-resistant member and the like used at high temperature, such as a housing of various sensors, heat-resistant bolt, disc spring, leaf spring, muffler and exhaust manifold.

What is claimed is:

1. A ferritic stainless steel, consisting of, in mass %:
0.001%≤C≤0.020%,
0.05%≤Si≤0.50%,
0.1%≤Mn≤1.0%,
15.0%≤Cr≤25.0%,
Mo<0.50%,
1.4%≤W≤2.5%, and
0.01%≤Nb≤0.40%, and
at least one member selected from the group consisting of:
Ni≤2.0%,
Ti≤0.50%,
Ta≤0.50%,
B≤0.0080%,
Mg≤0.0100%, and
Ca≤0.0100%,
with a balance being Fe and unavoidable impurities,
having a content of coarse Laves phase having a diameter of 0.50 μm or more being 0.1% or less,
having an average grain size being 30 μm or more and 200 μm or less, and
having a solid-solution temperature of a Laves phase of 950° C. or less.

2. The ferritic stainless steel according to claim 1, having an introduction amount of strain being 0.01 or more.

3. The ferritic stainless steel according to claim 1, having a content of fine Laves phase having a diameter of 0.20 μm or less being 0.05% or more.

4. The ferritic stainless steel according to claim 1, comprising in mass %:
0.1%≤Ni≤2.0%.

5. The ferritic stainless steel according to claim 1, comprising at least one of, in mass %:
0.01%≤Ti≤0.50%, and
0.01%≤Ta≤0.50%.

6. The ferritic stainless steel according to claim 1, comprising at least one of, in mass %:
0.0001%≤B≤0.0080%,
0.0005%≤Mg≤0.0100%, and
0.0005%≤Ca≤0.0100%.

7. The ferritic stainless steel according to claim 1, wherein the content of coarse Laves phase having a diameter of 0.50 μm or more is less than 0.01%.

8. The ferritic stainless steel according to claim 1, wherein the at least one member is selected from the group consisting of, in mass %:
Ta≤0.50%,
Mg≤0.0100%, and
Ca≤0.0100%.

9. The ferritic stainless steel according to claim 1, wherein the at least one member comprises Ta≤0.50%.

10. A heat-resistant member comprising a ferritic stainless steel, wherein the ferritic stainless steel, consists of, in mass %:
0.001%≤C≤0.020%,
0.05%≤Si≤0.50%,
0.1%≤Mn≤1.0%,
15.0%≤Cr≤25.0%,
Mo<0.50%,
1.4%≤W≤2.5%,
0.01%≤Nb≤0.40%,
Ni≤2.0%,
Ti≤0.50%,
Ta≤0.50%,
B≤0.0080%,
Mg≤0.0100%, and
Ca≤0.0100%,
with a balance being Fe and unavoidable impurities,
has a content of coarse Laves phase having a diameter of 0.50 μm or more being 0.1% or less,
has an average grain size being 30 μm or more and 200 μm or less, has a content of fine Laves phase having a diameter of 0.20 μm or less being 0.05% or more, and has a solid-solution temperature of a Laves phase of 950° C. or less.

11. The heat-resistant member according to claim 10, wherein the ferritic stainless steel has an introduction amount of strain being 0.01 or more.

12. The heat-resistant member according to claim 10, wherein the ferritic stainless steel comprises at least one of, in mass %:

0.1%≤Ni≤2.0%, 0.01%≤Ti≤0.50%, 0.01%≤Ta≤0.50%, 0.0001%≤B≤0.0080%, 0.0005%≤Mg≤0.0100%, and 0.0005%≤Ca≤0.0100%.

13. The ferritic stainless steel according to claim 10, wherein the content of coarse Laves phase having a diameter of 0.50 μm or more is less than 0.01%.

14. A ferritic stainless steel, consisting of, in mass %:

0.001%≤C≤0.020%, 0.05%≤Si≤0.50%, 0.1%≤Mn≤1.0%, 15.0%≤Cr≤25.0%,

Mo<0.50%, 1.4%≤W≤2.5%, 0.01%≤Nb≤0.40%, with a balance being Fe and unavoidable impurities, having a content of coarse Laves phase having a diameter of 0.50 μm or more being 0.1% or less, having an average grain size of 30 μm or more and 200 μm or less, and having a solid-solution temperature of a Laves phase of 950° C. or less.

15. The ferritic stainless steel according to claim 14, wherein an introduction amount of strain is 0.01 or more.

16. The ferritic stainless steel according to claim 14, wherein a content of fine Laves phase having a diameter of 0.20 μm or less is 0.05% or more.

17. The ferritic stainless steel according to claim 14, wherein the content of coarse Laves phase having a diameter of 0.50 μm or more is less than 0.01%.

18. A heat-resistant member comprising a ferritic stainless steel, wherein the ferritic stainless steel, consists of, in mass %:

0.001%≤C≤0.020%, 0.05%≤Si≤0.50%, 0.1%≤Mn≤1.0%, 15.0%≤Cr≤25.0%,

Mo<0.50%, 1.4%≤W≤2.5%, 0.01%≤Nb≤0.40%, with a balance being Fe and unavoidable impurities, having a content of coarse Laves phase having a diameter of 0.50 μm or more being 0.1% or less, having an average grain size of 30 μm or more and 200 μm or less, and having a solid-solution temperature of a Laves phase of 950° C. or less.

* * * * *